US008985376B2

(12) United States Patent
Musso

(10) Patent No.: US 8,985,376 B2
(45) Date of Patent: Mar. 24, 2015

(54) FRAC TANKS

(75) Inventor: Tom W. Musso, Bath, NY (US)

(73) Assignee: Crown Tank Company, LLC, Prattsburgh, NY (US)

( * ) Notice: Subject to any disclaimer, the term of this patent is extended or adjusted under 35 U.S.C. 154(b) by 115 days.

(21) Appl. No.: 13/611,595

(22) Filed: Sep. 12, 2012

(65) Prior Publication Data

US 2014/0069932 A1 Mar. 13, 2014

(51) Int. Cl.

| | |
|---|---|
| ***B65D 1/24*** | (2006.01) |
| ***B65D 88/12*** | (2006.01) |
| ***F17C 1/00*** | (2006.01) |
| ***B65D 88/02*** | (2006.01) |
| ***B65D 90/00*** | (2006.01) |
| ***B65D 90/08*** | (2006.01) |
| ***B65D 90/16*** | (2006.01) |

(52) U.S. Cl.

CPC ..... *B65D 90/08* (2013.01); *B65D 88/027* (2013.01); *B65D 90/0066* (2013.01); *B65D 90/16* (2013.01); *Y10T 29/49826* (2015.01)

USPC ..... 220/501; 220/564; 220/584

(58) Field of Classification Search

CPC ..... F17C 2209/232; F17C 2201/0152; F17C 2209/221; B60P 3/22; B60P 3/221; B60P 3/224; Y02E 60/321

USPC ..... 220/567.2, 562–564, 566, 584, 501, 220/837, 839, DIG. 24; 280/830, 837, 839; 410/68

See application file for complete search history.

(56) References Cited

U.S. PATENT DOCUMENTS

| | | | | |
|---|---|---|---|---|
| 2,106,495 | A * | 1/1938 | Hermann | 72/57 |
| 2,672,254 | A * | 3/1954 | Boardman | 220/565 |
| 3,059,802 | A * | 10/1962 | Mitchell | 220/675 |
| 3,712,502 | A * | 1/1973 | Basier et al. | 220/564 |
| 4,946,056 | A * | 8/1990 | Stannard | 220/584 |
| 2009/0050635 | A1 * | 2/2009 | Richards et al. | 220/584 |
| 2011/0031257 | A1 | 2/2011 | Metz | |
| 2011/0061855 | A1 * | 3/2011 | Case et al. | 166/113 |

* cited by examiner

*Primary Examiner* — Bryon Gehman
*Assistant Examiner* — Shawn M Braden
(74) *Attorney, Agent, or Firm* — Alix, Yale & Ristas, LLP

(57) ABSTRACT

A frac tank adapted for vehicular transport and field storage of a liquid, comprising two parallel, elongated, hollow, intersecting cylinder sections that are capped at the longitudinal ends. Each section has an arcuate wall defining a cross-section of greater than 180°, a major diameter, and a minor diameter at the ends of the arcuate wall, wherein the ends of the arcuate wall of each section are sealingly joined to form the tank wall. The joined ends of the arcuate walls form inwardly directed cusps along the length of the tank with the major diameters spaced apart on either side of the cusps.

13 Claims, 5 Drawing Sheets

FRAC TANKS

BACKGROUND

The present invention relates to so-called "frac tanks" which are used in connection with production in oil and gas wells. The tanks contain thousands of gallons of water or proppant, which is pumped under high pressure down the well bore to push open, i.e., fracture, the earth formation or to keep the formation open.

It is known to provide cylindrical frac tanks supported on L-skids, which brace the tanks externally and enable the tanks to be transported to the field and repositioned upright on a well pad for production. The tanks generally have a capacity of about 400 barrels, requiring a diameter of 12 feet. This width of tank has caused difficulties during transport on truck bodies over public roads, requiring special permitting, administration, and thus additional cost.

SUMMARY

The purpose of the present invention is to provide a cylinder-type frac tank that does not require extensive internal reinforcement, avoids the difficulties and costs associated with the transport of conventional over-width cylindrical frac tanks, and is at least as space efficient as cylindrical frac tanks when arrayed on a well pad or the like.

The frac tank of the present invention can be considered as having the shape of two intersecting parallel cylinders.

With this shape, tanks having a maximum width of only eight feet and a capacity of about 300 barrels can easily be transported on a conventional flatbed truck, without special permitting and administrative delays and costs. As an example of deployment, an array of twelve such tanks closely spaced on a well pad of given size, provides greater capacity than a closely spaced array of eight 400 barrel cylindrical tanks on the same size pad.

According to one aspect, the invention is disclosed as a frac tank adapted for vehicular transport and field storage of a liquid, comprising two elongated hollow sections, each section having an arcuate wall defining a cross-section of greater than 180°, a major diameter, and a minor diameter at the ends of the arcuate wall, wherein the ends of the arcuate wall of each section are sealingly joined. The joined ends of the arcuate walls form inwardly directed cusps along the length of the tank with the major diameters spaced apart on either side of the cusps.

In a more detailed aspect, the disclosure includes an optional L-frame skid having one leg joined to an exterior surface of the wall of one section and another leg joined to the bottom of the tank. The one leg of the frame is attached to a truck body for horizontally orientated transport of the tank to the field, and the tank with skid are removable from the truck body for upright positioning of the tank in the field while resting on the other leg of the frame.

The invention can take the form of a stand-alone tank, a tank unit in which the tank is in combination with a skid or similar support, or a plurality of tanks arrayed in the field.

Another aspect of the invention is a method of fabricating a frac tank having the shape of two hollow, intersecting parallel cylinder sections. The method comprises: fabricating a plurality of metal rings, each ring composed of two opposed segments, with one segment forming a portion of one cylinder section and the other segment forming a portion of the other cylinder section, each segment having an arcuate wall defining a cross section of greater than 180 deg.; sealingly joining the ends of the arcuate wall of each segment to produce a plurality of metal rings; joining the rings to form an elongated tank wall having open ends; and capping the open ends of the tank wall.

DETAILED DESCRIPTION

Figure 1:
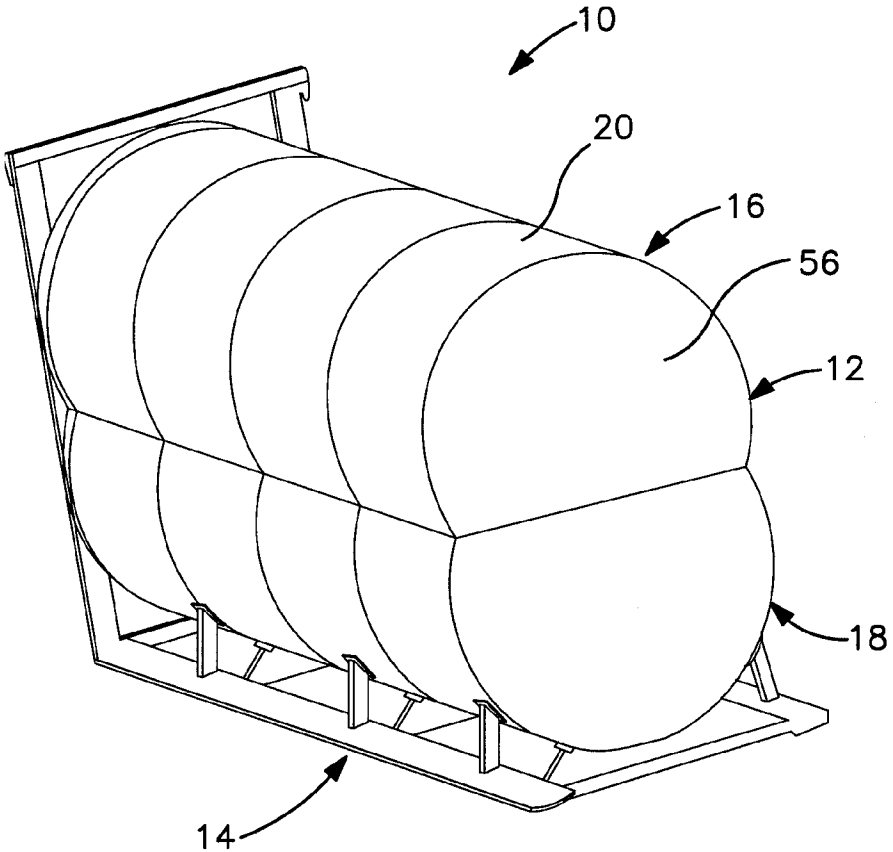
FIG. 1 is an oblique view taken from above a frac tank unit including tank and skid or frame.

FIG. 1 shows a horizontally oriented tank unit 10 formed by the combination of tank or container 12 and skid or frame 14. The tank has a first or upper section 16 (resembling a portion of one hollow cylinder), and a second or lower section 18 (resembling a portion of another hollow cylinder). The tank 12 is formed by a plurality of connected rings 20. In the orientation of FIG. 1, the tank unit 10 can be loaded onto a transport vehicle such as a flatbed truck and delivered to a drilling or production site.

Figure 2:
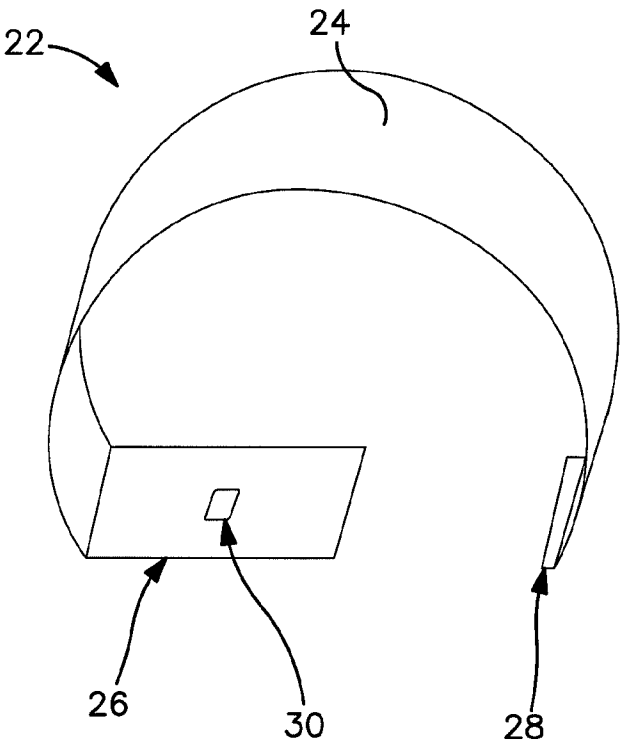
FIG. 2 shows one segment of the tank, which is mateable with an identical segment, to form one ring of a plurality of rings that are joined together to form the tank.

FIG. 2 shows the basic building block for each ring 20. Each ring is composed of two segments 22, each having a rolled portion 24 defining an arcuate wall which spans an arc of more than 180°. At one end of the arcuate wall, a relatively longer flange 26 extends substantially horizontally, and at the other end of the arcuate wall, a relatively shorter flange 28 also extends horizontally, leaving a gap between the two flanges. An opening 30 in the longer flange is provided to assure that the fluid in the tank can pass freely within the volume to maintain balanced weight distribution.

Figure 3:
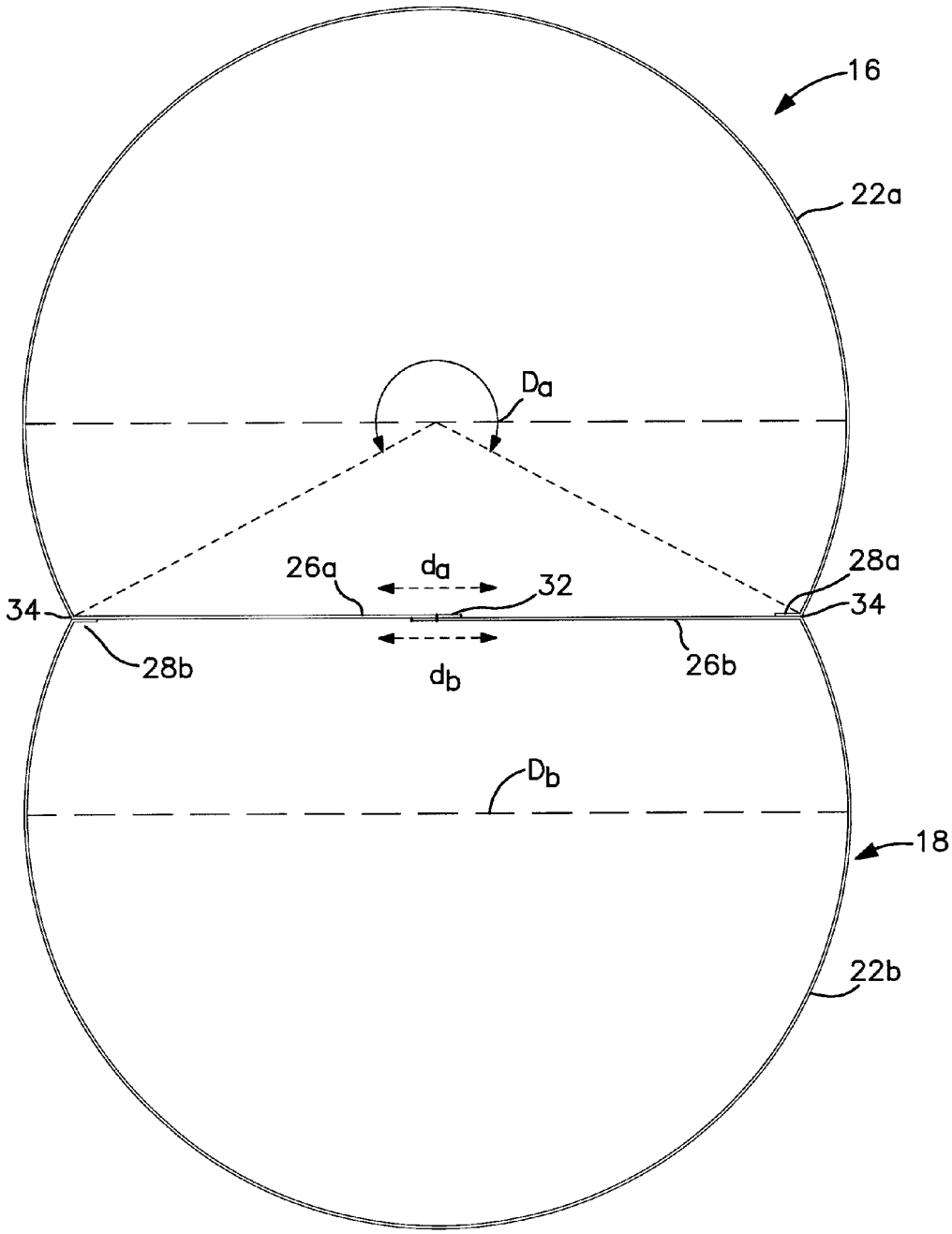
FIG. 3 is an end view of a representative mid-region of the tank, showing how two segments are joined together to form a ring which resembles the intersection of two parallel cylinders.

FIG. 3 shows how two of the segments 22*a*, 22*b* are joined together to form one ring among the plurality of rings that define the overall cross-section of the tank, which resembles the intersection of two parallel cylinders. Preferably, the upper and lower segments 22*a*, 22*b* are identically fabricated. They are joined such that the second segment 22*b* is reoriented by two, 180° rotations relative to the first segment 22*a*.

Thus, the longer flange 26*a* confronts the shorter flange 28*b* and the longer flange 26*b* confronts the shorter flange 28*a*. The confronting flanges are welded together along the full length of the cusp 34 (of the ring) formed at the intersection of the segments. The longer flanges 26*a*, 26*b* overlap at the center of the ring at 32 and are also welded together.

Upon viewing FIG. 3, it can be appreciated that the maximum width of the tank is at the major diameter $D_a$ and (with identical segments) at the identical major diameter $D_b$. One can consider that the minor diameters $d_a$ and $d_b$ are defined at the ends of the arcuate wall of each segment, and that is where the flanges form a support plate that connects the opposed cusps 34.

Figure 4:
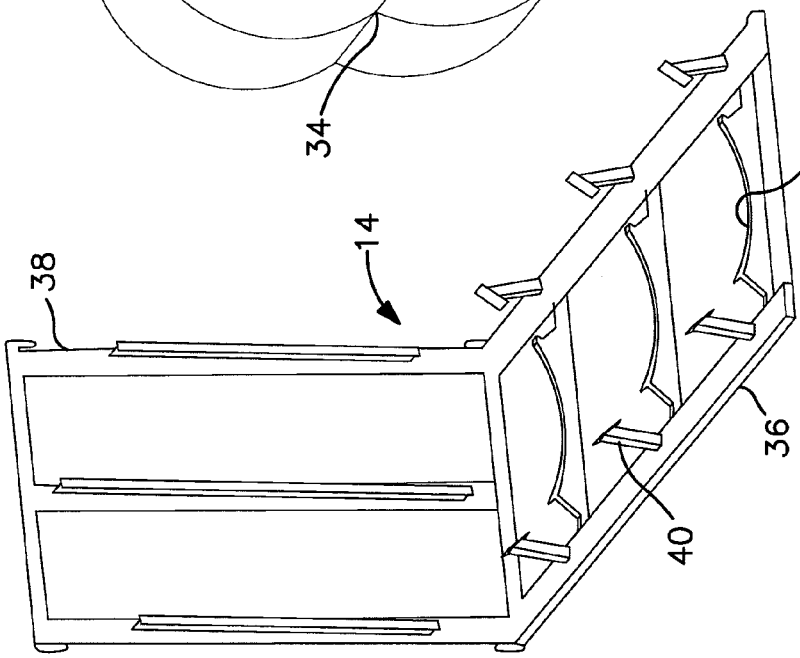
FIG. 4 is an oblique view of a representative skid or frame.

FIG. 4 shows the preferred form of the frame 14, comprising a horizontal, preferably longer leg 36 and a vertical, preferably shorter leg 38. Leg 36 has a plurality of straight support posts 40 and transverse, curved braces 42 that are supported by horizontal rails 44. The other leg 38 is likewise formed from a plurality of rails 46 which carry respective support bars 48.

Figure 5:
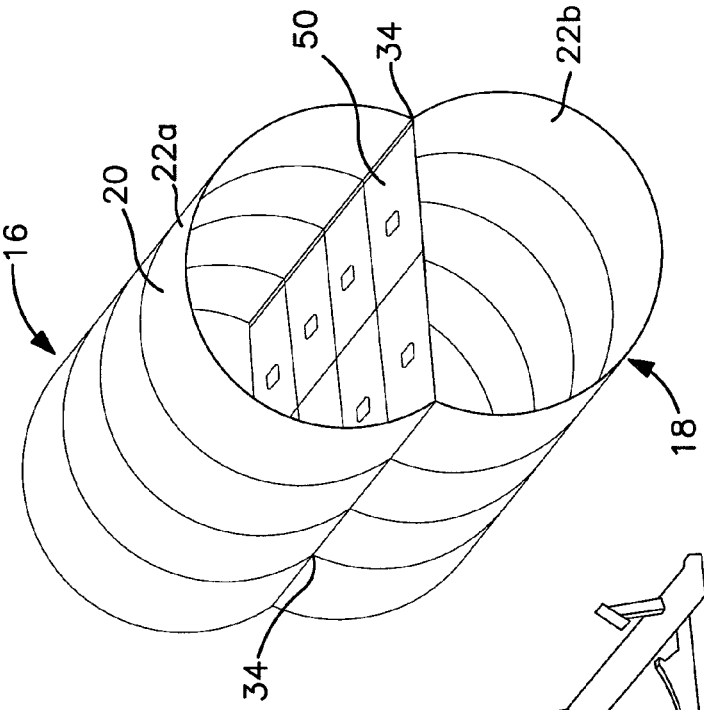
FIG. 5 is an oblique view of the tank before the end caps have been secured.

FIG. 5 shows the tank during fabrication, wherein the cusps 34 can be seen more clearly as extending longitudinally at the intersection of the upper 16 and lower 18 sections of the tank. In the illustrated embodiment, four individually pre-assembled rings 20 are welded together, with each ring formed by the joining of segments 22*a* and 22*b* as described with respect to FIG. 3. The joining of the flanges within a ring and the optional joining of adjacent flanges from adjacent rings forms an overall unitary central support plate 50 extending between the cusps 34 of the tank, or a plurality of side by side supports plates associated with respective rings.

The plates 50 provide support against unbalanced force components that might arise at the inward (i.e., concave) cusps 34, in a direction parallel to the minor diameter. However, the convex arcuate shape of most of the ring surface 24 retains the strength of a cylindrical tank and needs no support or reinforcement against force components in a direction perpendicular to the minor diameter.

It should be understood that in the illustrated embodiment the upper and lower segments 16, 18 have the same size and shape, and thus the major diameters $D_a$ and $D_b$, and minor diameters $d_a$ and $d_b$ are the same, with the minor diameters being congruent and coextensive, and the major diameters spaced apart on either side of the minor diameters and cusps, but this is not absolutely necessary. Each segment 22*a*, 22*b* and thus each section 16, 18 is a portion of a cylinder in which the ends of the arcuate wall preferably span an included angle of at least about 200 deg., most preferably in the range of 220-250 deg.

The internal support for the tank can take a variety of forms, with at least one reinforcing member extending between spaced apart points on the wall of each section, preferably extending between the cusps.

Figure 6:
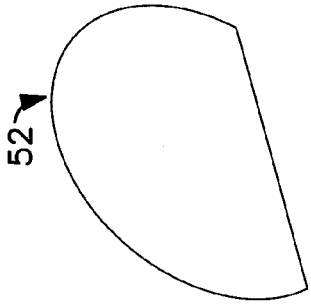
FIG. 6 is an oblique view of one of two bottom caps for the tank.
Figure 7:
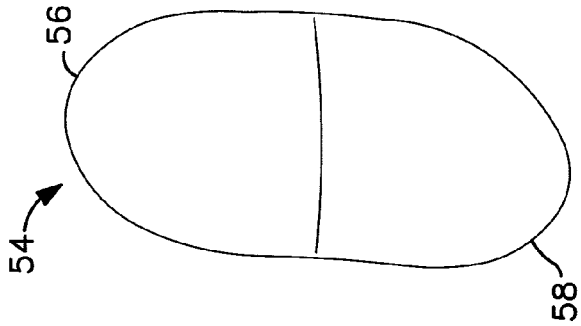
FIG. 7 is an oblique view of the top cap of the tank.
Figure 8:
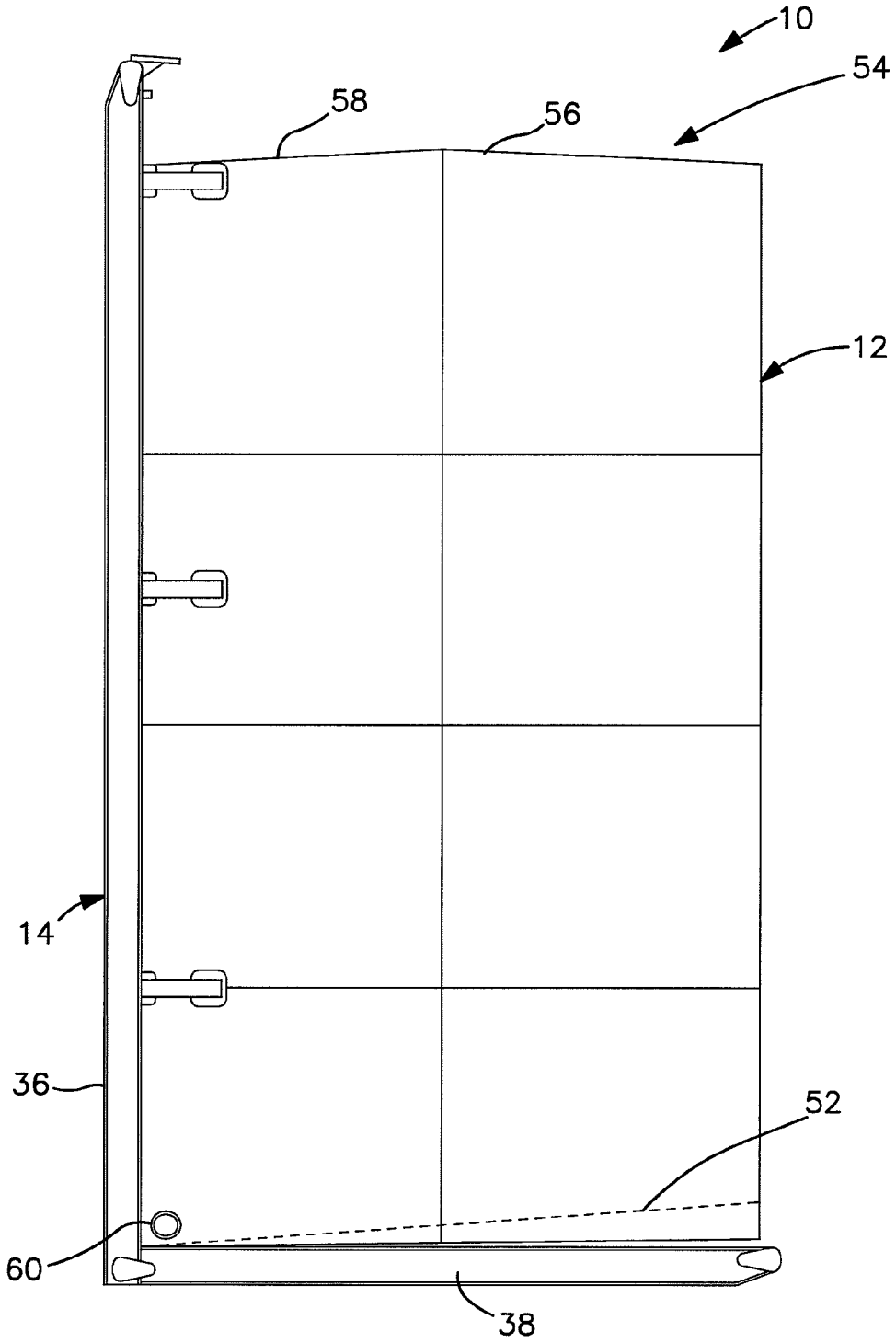
FIG. 8 is a schematic, longitudinal view of the tank unit, showing the preferred shape and orientation of the end caps.

FIGS. 6, 7 and 8 show the preferred manner in which the ends of the tank 12 are closed, with FIG. 8 also depicting the tank unit 10 as would be deployed upright in the field for short term use. The bottom of the tank is closed at an angle by one or two connected bottom caps 52 and the closure 54 at the top of the tank has two angled portions 56, 58. The angle at the bottom assures that all liquid in the tank flows toward the valve 60, whereas the angle at the top helps shed rain or snow, etc.

Figure 9:
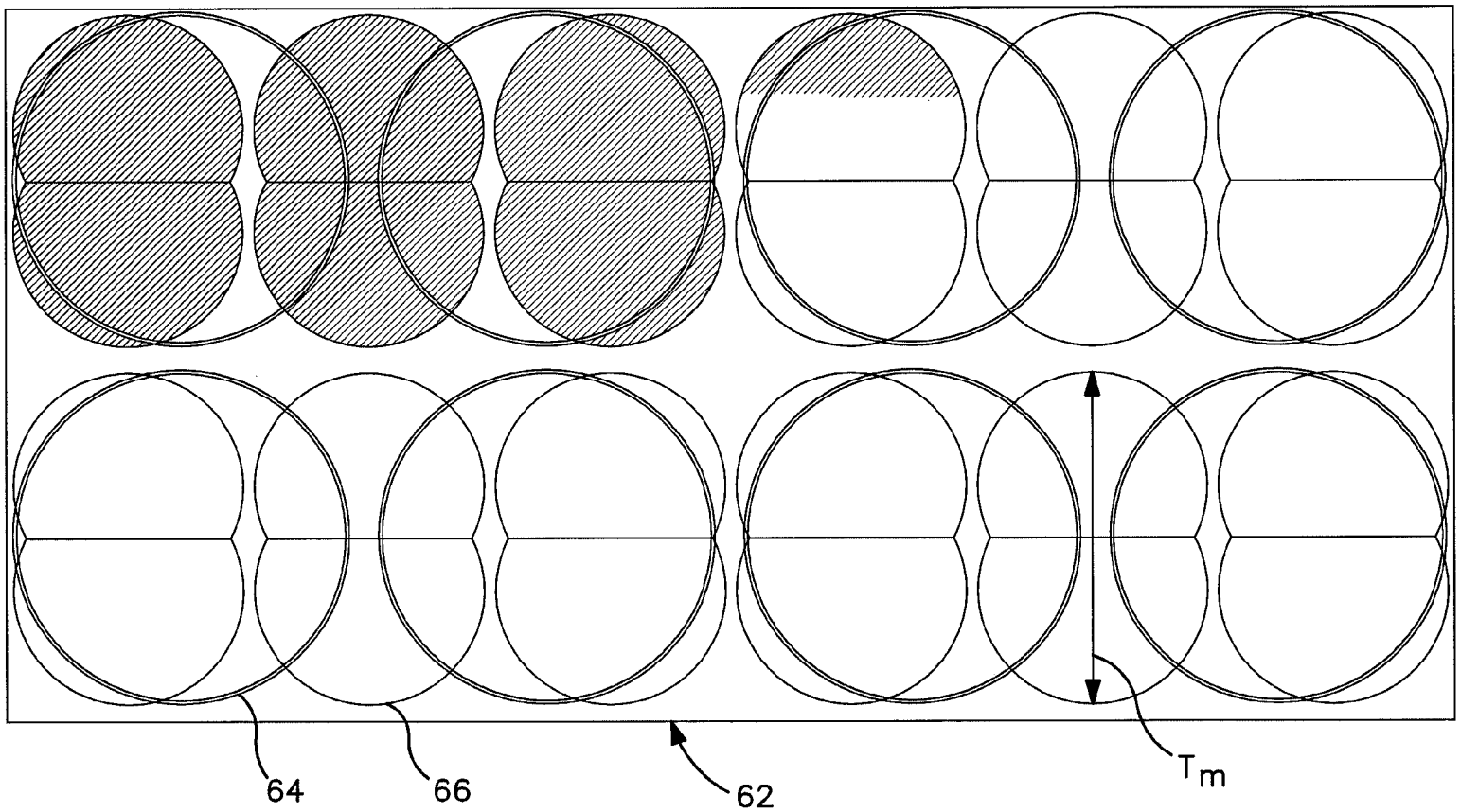
FIG. 9 shows the footprints of twelve intersecting cylinder tanks, each having eight foot major diameters, superimposed on the footprints of eight conventional cylindrical tanks having twelve foot diameters.

FIG. 9 shows the perimeter of one possible frac tank well pad 62, which for convenience is selected as a 26 ft.×52 ft. rectangle, on which a plurality of frac tanks are situated without skids or frame, for long-term use. The pad accommodates eight conventional cylindrical tanks 64, each having a twelve foot diameter and a 400 barrel capacity, for a total volume of 3,200 barrels. The footprints of the eight conventional tanks are superimposed with the footprints of twelve tanks 66 according to FIG. 8 (without the skid), each having the same height but with a major diameter (maximum width of one section) of eight feet and a capacity of almost 300 barrels, for a total volume of 3,526 barrels. In this comparison, the maximum transverse dimension $T_m$ of the inventive tank 66 is about twelve feet, the same as the diameters of the cylindrical tanks 64. In this preference but not limitation, the maximum transverse dimension $T_m$ is 50% greater than the major diameters $D_a$ and $D_b$.

It can thus be appreciated that the present invention provides a frac tank of smaller width that is more convenient to transport by truck relative to a conventional twelve foot diameter frac tank. When arrayed on a well pad of given area, similar or greater fluid capacity can also be achieved. Although to achieve this capacity advantage more tanks must be fabricated, the net cost is no greater. The total required surface areas of metal are similar, but the metal blanks can be thinner and more easily shaped and welded for the inventive tanks. Even if the inventive tanks did not provide any initial manufacturing cost advantage for the same total fluid volume required on a particular well pad or site, the combined advantages of routine tank transport without sacrificing fluid volume capacity on a given well pad, represent a significant improvement over conventional practice.

The invention claimed is:

1. A frac tank extending between longitudinal ends, comprising:

two elongated hollow sections, each section having an imperforate arcuate section wall defining an arcuate wall of greater than 180 degrees in cross section from one end of the arcuate section wall to another end of the arcuate section wall, a major diameter, and a minor diameter at the ends of the arcuate section wall, wherein the tank is composed of a plurality of longitudinally abutting and welded rings, each ring composed of two opposed segments welded together, with one segment forming a portion of one section and the other segment forming a portion of the other section, each segment having an arcuate segment wall defining a cross section of greater than 180 deg. from one end of the arcuate segment wall to another end of the arcuate segment wall, a major diameter, and a minor diameter at the ends of the arcuate segment wall, with the ends of the arcuate wall of each segment sealingly joined and with the ends of the arcuate wall of each section sealingly joined; and a cap is provided at each longitudinal end of the tank.

2. The tank of claim 1, wherein each opposed segment has a flange extending inwardly from each end of the arcuate segment wall, and the flanges of one segment are welded to the flanges of the opposed segment.

3. The tank of claim 2, wherein the flanges as welded form a support plate that joins the ends of the arcuate segment walls of both segments.

4. The tank of claim 3, wherein the support plate of each ring is welded to the support plate of an adjacent ring.

5. The tank of claim 1, wherein the tank has top and bottom longitudinal ends, and an L frame skid has a relatively longer leg joined to an exterior surface of the wall of one section and another, relatively shorter leg supporting the bottom end of the tank.

6. The tank of claim 1, wherein the major diameter is eight feet and a maximum transverse dimension $t_m$ through the centers of both sections is 12 feet.

7. The tank of claim 1, wherein a plurality of said tank is arrayed in upright position on a pad;

each tank has a maximum transverse dimension $t_m$ through the centerlines of the joined sections that is 50% greater than the major diameters $D_a$ and $D_b$ of the respective joined sections;

one row of a plurality of said tanks is arrayed adjacent to and in parallel with another row of a plurality of said tanks;

the maximum transverse dimension of each tank of said one row is linearly aligned with the maximum transverse dimension of a tank in said other row;

the respective major diameters $D_a$ and $D_b$ of each section are equal; and the respective minor diameters $d_a$ and $d_b$ of each section are equal and congruent.

8. A method for fabricating a frac tank formed as two parallel, elongated, hollow, intersecting cylinder sections, comprising:

fabricating a plurality of metal rings, each ring composed of two opposed segments, with one segment forming a portion of one cylinder section and the other segment forming a portion of the other cylinder section, each segment having an arcuate wall defining a cross section of greater than 180 deg., a major diameter, and a minor diameter at the ends of the arcuate wall;

sealingly joining the ends of the arcuate wall of each segment to produce a plurality of said metal rings;

means for reinforcing each metal ring between the ends of the arcuate walls of the respective opposed segments;

joining the rings to form an elongated tank wall having open ends; and capping the open ends of the tank wall.

9. The method of claim 8, wherein, each opposed segment has a flange extending inwardly from each end of the arcuate wall;

the flanges of one segment are welded to the flanges of the opposed segment;

whereby the flanges as welded form a support plate that joins the ends of the arcuate walls of both segments and provides said reinforcing means.

10. An array of adjacently spaced frac tanks extending vertically between top and bottom longitudinal ends, wherein each frac tank comprises:

two elongated hollow sections, each section having an imperforate arcuate wall defining a cross section of greater than 180 degrees from one end of the arcuate wall to another end of the arcuate wall, a major diameter, and a minor diameter at the ends of the arcuate wall, wherein the ends of the arcuate wall of each section are sealingly joined and thereby join the sections;

a valve at the bottom end of the tank; further wherein when viewed longitudinally, the joined sections form intersecting parallel cylinders having respective spaced apart centerlines, with inwardly directed cusps formed at the minor diameters, along the length of the tank, and with the major diameters passing through the respective centerlines;

a perforated support plate extending between the ends of the segments thereby joining the cusps along the length of the tank;

the ends of each arcuate wall span an included angle within a range of 200-250 degrees around the respective centerlines;

a plurality of said tank is arrayed in upright position on a pad exposed to weather; and each tank has a top cap angled to shed precipitation and a bottom cap angled downwardly toward said valve.

11. The tank of claim 10, wherein each tank has a maximum transverse dimension $t_m$ through the centerlines of the joined sections that is greater than the major diameters $D_a$ and $D_b$ of the respective joined sections;

one row of a plurality of said tanks is arrayed adjacent to and in parallel with another row of a plurality of said tanks; and the maximum transverse dimension of each tank of said one row is linearly aligned with the maximum transverse dimension of a tank in said other row.

12. The tank of claim 11, wherein the respective major diameters $D_a$ and $D_b$ of each section are eight feet in length;

the respective minor diameters $d_a$ and $d_b$ of each section are equal and congruent; and the maximum dimension $t_m$ across the tank through the centers of both sections is 12 feet.

13. The tank of claim 12, wherein two rows of six tanks each are arrayed on one pad.

* * * * *